United States Patent [19]

Carrieri et al.

[11] 4,238,950

[45] Dec. 16, 1980

[54] BOLSTER ARRANGEMENT FOR OPPOSED SLIDE DOUBLE ACTING PRESS

[75] Inventors: Louis F. Carrieri, LaGrange Park; Edwin A. Spanke, Oak Forest, both of Ill.

[73] Assignee: Gulf & Western Manufacturing Company, Southfield, Mich.

[21] Appl. No.: 28,274

[22] Filed: Apr. 9, 1979

[51] Int. Cl.[3] ..... B21J 13/02

[52] U.S. Cl. ..... 72/446; 72/407; 72/450; 100/264

[58] Field of Search ..... 72/446, 447, 448, 450, 72/407, 455; 100/264, 299, DIG. 18

[56] References Cited

U.S. PATENT DOCUMENTS

| | | | |
|---|---|---|---|
| 25,427 | 9/1859 | Lindsay | 100/226 |
| 487,271 | 12/1892 | Hodgson | 72/351 |
| 1,849,670 | 3/1932 | Glasner | 72/336 |
| 2,150,890 | 3/1939 | Franghia | 72/330 |
| 2,245,573 | 6/1941 | Criley | 72/448 |
| 2,411,503 | 11/1946 | Calleson | 72/20 |
| 2,913,946 | 11/1959 | Ellrich | 100/299 |
| 3,134,350 | 5/1964 | Danly | 72/414 |
| 3,371,515 | 3/1968 | Munschauer | 72/446 |
| 3,422,660 | 1/1969 | Countess | 72/448 |
| 3,422,661 | 1/1961 | Blackhurst | 72/448 |
| 3,422,662 | 1/1969 | Geuss | 72/448 |
| 3,427,854 | 2/1969 | Michelson | 72/448 |
| 3,427,855 | 2/1969 | Michelson | 72/448 |
| 3,498,102 | 3/1970 | Warstler | 72/470 |
| 3,841,141 | 10/1974 | Rachwal | 72/446 |
| 3,889,515 | 6/1975 | Grombka | 72/448 |
| 4,026,226 | 5/1977 | Hahn | 113/1 F |

*Primary Examiner*—Francis S. Husar
*Assistant Examiner*—Gene P. Crosby
*Attorney, Agent, or Firm*—Meyer, Tilberry & Body

[57] ABSTRACT

A double acting press is disclosed having upper and lower vertically reciprocable slides and a bolster assembly therebetween, which bolster and slides support tooling for cutting and drawing a cup-shaped article from a flat blank of sheet metal in response to a cycle of reciprocation of the upper and lower slides. The bolster assembly is releaseably clamped in place with respect to the press frame during press operation and is adapted to be released from the frame and supported for rolling movement laterally outwardly of the frame to facilitate tool inspection, maintenance and replacement operations. Tooling associated with the upper and lower slides is adapted to be supported by the bolster assembly so that the entire tool package is movable into and out of the press confines with the bolster assembly.

21 Claims, 8 Drawing Figures

BOLSTER ARRANGEMENT FOR OPPOSED SLIDE DOUBLE ACTING PRESS

BACKGROUND OF THE INVENTION

The present invention relates to the art of presses and, more particularly, to opposed slide double acting presses having a bolster assembly between the slides.

The present invention finds particular utility in connection with opposed slide double acting presses having a bolster assembly between the slides and which bolster assembly and slides support corresponding tooling which is cooperable to cut a circular blank from flat sheet metal and to draw the circular blank to a cup-shaped contour. Accordingly, the invention will be disclosed and described in detail with regard to a press and tooling construction for this purpose. At the same time, it will be appreciated that the bolster arrangement in accordance with the present invention can be employed with opposed slide double acting presses in which tooling on the bolster assembly and slides is cooperable to perform work other than the cutting and drawing of sheet metal blanks.

Double acting presses having opposed vertically reciprocable upper and lower slides and an intermediate bolster assembly are advantageous for a number of reasons in connection with metalworking operations which require the characteristics of a double acting press, namely a first slide having tooling cooperable with tooling on the bolster to cut and hold a blank and a second slide having tooling cooperable with tooling on the bolster to form or shape the blank. Among the advantages of an opposed slide double acting press having an intermediate bolster assembly is the fact that both slides have a maximum tool supporting area available for use, whereby a larger number of articles can be produced during each cycle of press operation. A further advantage resides in the fact that the two slides in an opposed slide construction are independently supported for reciprocation relative to the press frame, thus avoiding undesirable guidance and vibration characteristics encountered in connection with the inner slide of a conventional double acting press wherein the outer slide is guided by the frame and the inner slide is guided by the outer slide. Still further, in an opposed slide double acting press in which the slides move toward and away from the intermediate bolster assembly, acceleration and deceleration forces of the slides tend to cancel each other whereas in a double acting press in which both slides move in the same direction, the acceleration and deceleration forces of the slides are partially additive.

It is of course well known that press tooling such as blank cutting dies, forming dies, drawing dies and drawing punches require frequent inspection to determine the condition thereof and, when necessary, removal of the tooling is required for repair and/or replacement purposes. In an opposed slide double action press, such inspection of the tooling while the latter is within the confines of the press is extremely difficult, especially where such inspection requires determination of the condition of interior portions of die cavities or the like. Furthermore, such inspection of tooling within the confines of the press is time consuming and subjects personnel to potential hazardous working conditions. The removal of tooling from the slides and bolster of an opposed slide double action press, and the replacement of such tooling is both difficult and time consuming and also subjects workmen to hazardous working conditions. In this respect, the position of the bolster between the upper and lower slides confines the available working space to that between the opposite sides of the bolster and the corresponding slide member. Thus, access to fasteners such as bolts which must be removed to achieve release of tooling components is restricted, whereby such removal is both tedious and time consuming.

Even though the tooling components may be mounted on a common support member for removal from one of the slides or bolster as a unit, such removal heretofore has required the use of exterior handling equipment, and the manoeuvring of such handling equipment and a tooling unit during an assembly or disassembly operation. These procedures, in addition to being time consuming and hazardous, require the exercise of care to avoid damage to the tooling components by engagement thereof with other press components. Even if the bolster is mounted on the press frame in a manner which enables removal of the bolster to increase the available work space with respect to tooling on the press slides, such removal of the bolster heretofore has been a time consuming operation and, again, requires the use of special exterior handling equipment for such removal and remplacement and, additionally, the provision of a special bench or support on which the bolster can be placed after removal. Further, the bolster often has tooling on the underside thereof, whereby the special support must enable access to the underside, or the bolster must be further manipulated once removed from the press to gain access to such tooling. Moreover, even though the bolster may be so removed, the tooling on the slides must be released and removed by independent operations.

SUMMARY OF THE INVENTION

In accordance with the present invention, the foregoing problems and others heretofore encountered in connection with opposed slide double action presses are avoided or minimized by providing a bolster arrangement which, during press operation, is releaseably interengaged with the press frame and which is adapted to be released and supported for displacement laterally outwardly of the press frame to facilitate inspection of tooling thereon and, if necessary, the removal of such tooling and the repair and/or replacement thereof. Further, while the bolster assembly is so supported laterally outwardly of the press frame, the tooling on the press slide is readily accessible for inspection in that the obstruction imposed by the bolster assembly is removed. Likewise, removal of the bolster assembly increases the working space available should it be necessary or desirable to remove tooling components from the slides, either individually or as a unit, for purposes of repair and/or replacement thereof.

In accordance with another aspect of the present invention, the displaceable bolster assembly facilitates the removal and insertion of an entire tooling package for the press. In this respect, tooling components associated with the upper side can be mounted on a common support plate releaseably attached to the slide and, prior to displacement of the bolster assembly laterally outwardly of the press frame, the upper slide tooling assembly can be released and supported on the upper side of the bolster assembly for displacement therewith. Moreover, tooling components associated with the lower slide can be mounted on a common support plate releaseably attached to the slide, and the support plate can be released and temporarily fastened to the bolster assembly in suspension therebeneath for displacement therewith laterally outwardly of the press frame. When the bolster assembly is in the laterally outward position relative to the press frame, the tooling assemblies for the slides can be readily removed therefrom for maintenance work and the like, replaced in their supported positions with respect to the bolster assembly, and then displaced back into the press frame for attachment to the corresponding slide.

Preferably, the bolster assembly is wedged into clamping interengagement with the press frame for stability during press operation and is adapted, when released, to be supported by tracks engaged by rollers on the bolster assembly for rolling displacement laterally outwardly of the press frame. Accordingly, it will be appreciated that the bolster assembly alone can be readily released and displaced laterally outwardly of the press frame to facilitate visual inspection of the slide tooling in the press, and inspection of the tooling on the bolster assembly outside the press. If maintenance and/or replacement is deemed unnecessary as a result of this inspection, the press can readily be prepared for further operation merely by displacing the bolster assembly back into the press frame and thence into clamping interengagement therewith. If, on the other hand, closer inspection of the slide tooling, or maintenance and/or replacement thereof is desired or necessary, one or both of the tooling assemblies can be released from the corresponding slide and supported on the bolster assembly for displacement therewith from the press frame. It will be appreciated, therefore, that the procedures for tooling inspection alone and/or tooling removal for inspection, repair or replacement can be achieved more readily than heretofore possible, with less likelihood of damage to tooling components, with increased safety for personnel and with reduced requirements with respect to the use of special handling equipment for supporting and displacing component parts relative to the press frame. Thus, inspection and maintenance procedures are more efficient, maintenance costs are decreased, and maintenance time and thus down time for the press is advantageously reduced.

It is therefore an outstanding object of the present invention to provide an opposed slide double acting press with a bolster assembly which is adapted to be releaseably clamped in place with respect to the press frame during press operation and, when released, supported for lateral displacement to a position outside the press frame to facilitate inspection and maintenance of the press and tooling associated therewith.

Another object is the provision of an opposed slide double acting press having a bolster assembly associated therewith in a manner which improves efficiency with respect to press and tooling inspection, and maintenance procedures, while minimizing hazardous working conditions for maintenance personnel.

A further object is the provision of an opposed slide double acting press with a bolster arrangement which decreases maintenance time and thus down time for the press in connection with the inspection, removal and replacement of tooling associated with the press, thus to improve the production rate for the press.

Still a further object is the provision of an opposed slide double acting press having a removable bolster assembly which enables tooling associated with the press slides to be selectively supported by the bolster assembly for displacement therewith, between positions within the press frame and laterally outwardly thereof.

BRIEF DESCRIPTION OF THE DRAWING

The foregoing objects, and others, will in part be obvious and in part pointed out more fully hereinafter in conjunction with the ensuing description of a preferred embodiment shown in the accompanying drawings in which.

DESCRIPTION OF A PREFERRED EMBODIMENT

Figure 1:
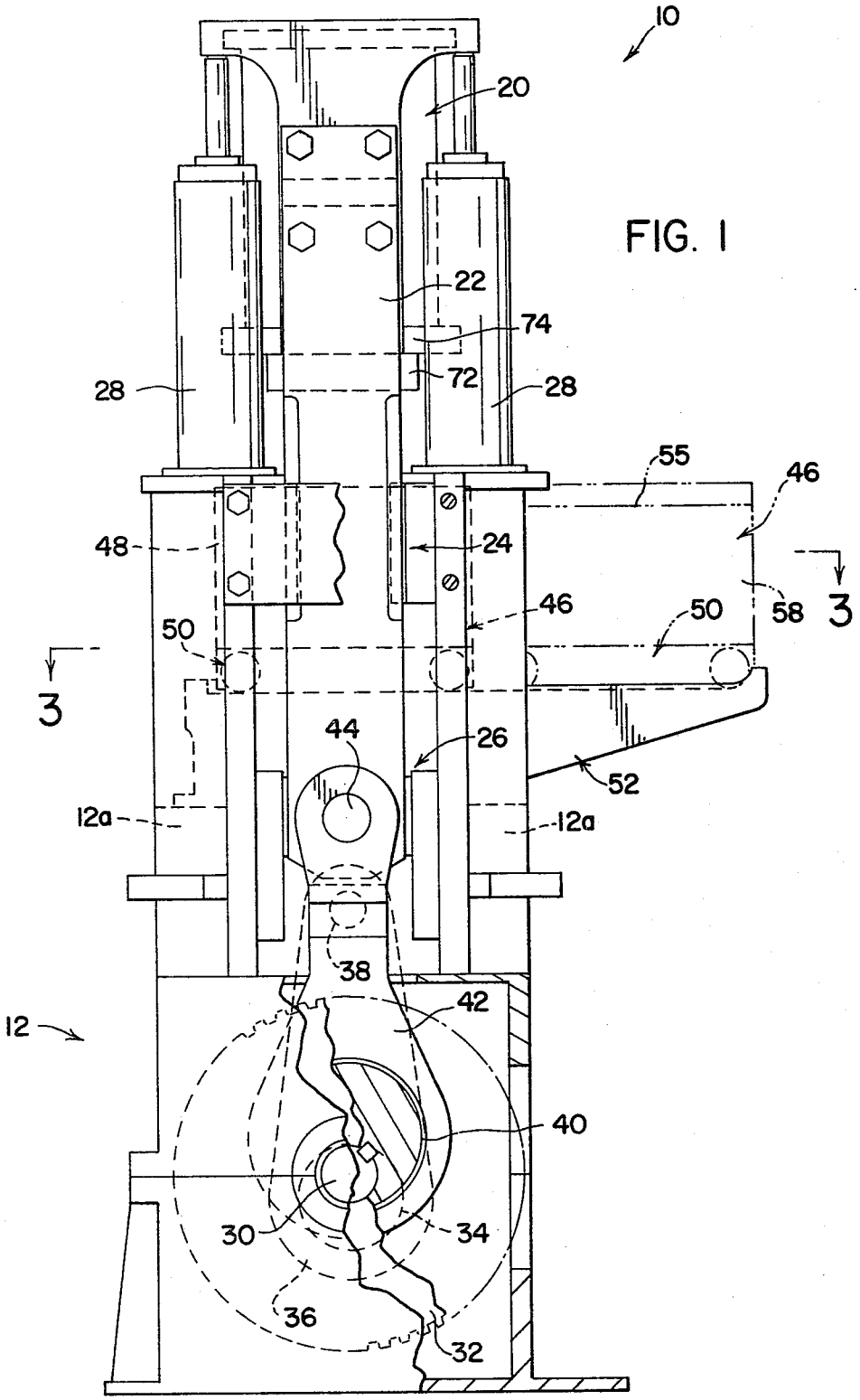
FIG. 1 is a side elevation view, partially in section, of an opposed slide double acting press having a bolster arrangement in accordance with the present invention and showing bolster support members extending laterally from the rear side of the press frame.
Figure 2:
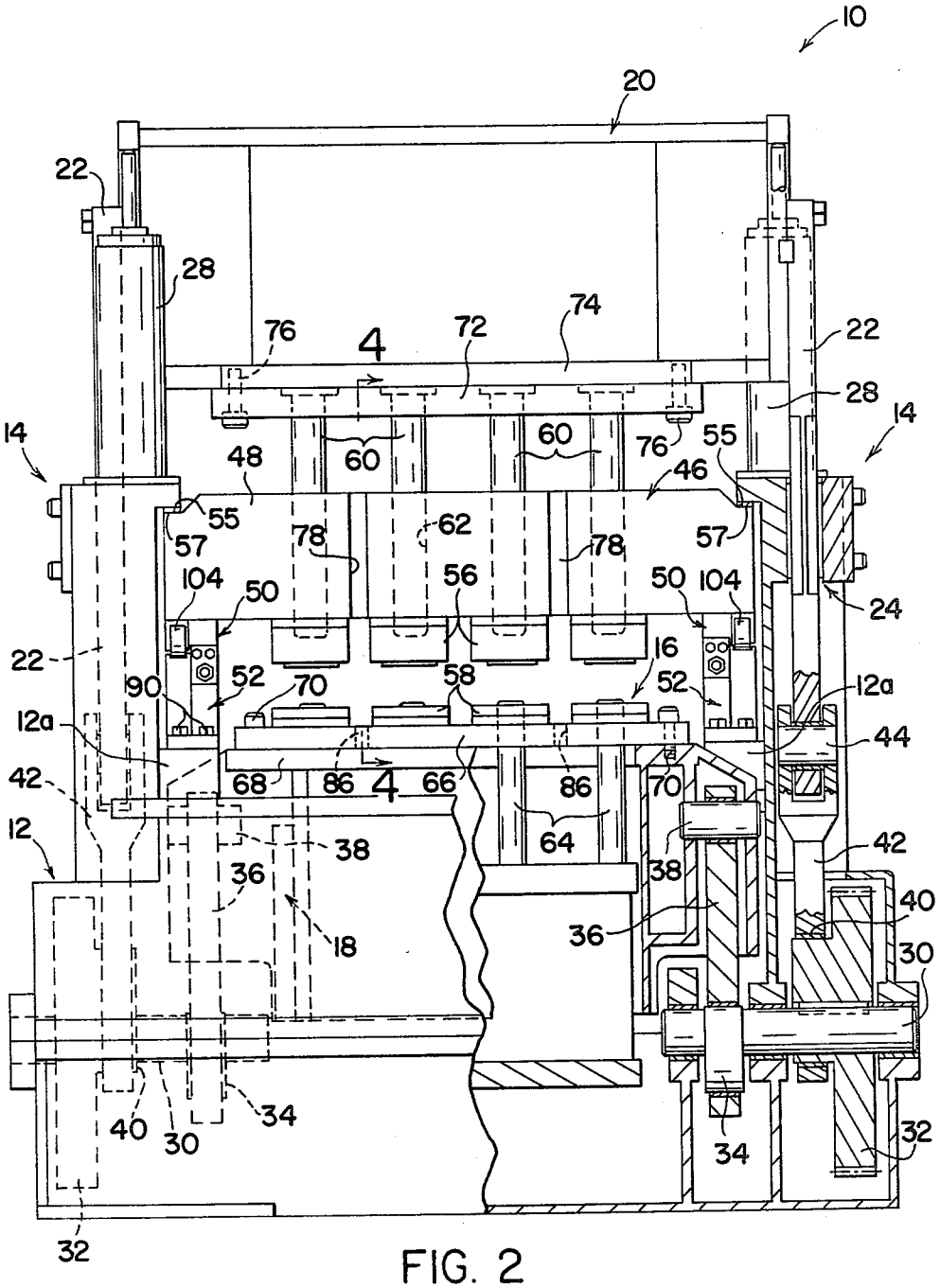
FIG. 2 is a front elevation view, partially in section, of the press shown in FIG. 1.
Figure 3:
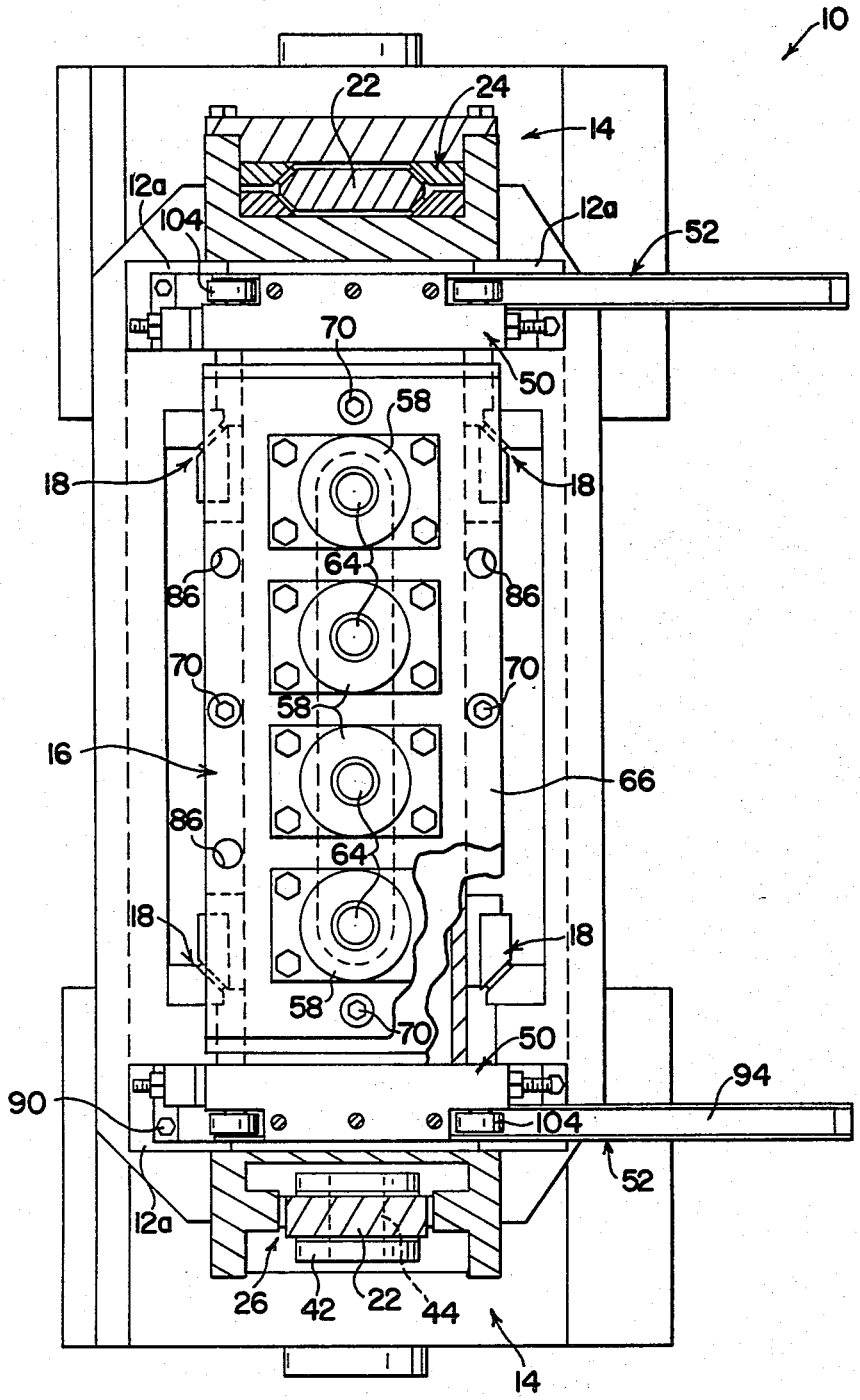
FIG. 3 is a sectional plan view of the press and bolster arrangement taken along line 3—3 in FIG. 1.

Referring now in greater detail to the drawings wherein the showings are for the purpose of illustrating a preferred embodiment of the invention only and not for the purpose of limiting the invention, as opposed slide double acting sheet metal cupping press 10 is shown in FIGS. 1–3 of the drawing. Press 10 includes a frame assembly comprised of lower portion 12 and spaced apart side portions 14 extending upwardly from lower portion 12. The press further includes a lower slide 16 supported for vertical reciprocation relative to the frame assembly by suitable gibbing 18, and an upper slide 20 supported for vertical reciprocation relative to the frame assembly by slide guide bars 22 extending vertically through side portions 14 of the frame assembly in slidable interengagement with corresponding upper and lower gibbing 24 and 26, respectively. The opposite sides of slide 20 are keyed and bolted to the upper ends of guide bars 22, and counterbalancing air cylinders 26 are interposed between the upper ends of side portions 14 and the upper end of slide 20.

The upper and lower slides are reciprocated relative to the frame assembly by a common crankshaft 30 having main gears 32 on the opposite ends thereof by which the crankshaft is rotated. Main gears 32 are adapted to be driven in a well known manner by corresponding pinions on a common back shaft, not shown, and which shaft is driven in any suitable manner such as, for example, by an electric motor driven clutch, brake and flywheel drive unit, not shown. Lower slide 16 is adapted to be reciprocated in response to rotation of crankshaft 30 by means of eccentrics 34 on the crankshaft and corresponding connecting rods 36 having their lower ends pivotally associated with the eccentrics and their upper ends pivotally interconnected with the lower slide by means of pins 38. Upper slide 20 is adapted to be reciprocated in response to rotation of shaft 30 by means of eccentrics 40 which, in the embodiment shown, are integral with main gears 32, and corresponding connecting rods 42 having their lower ends pivotally associated with the eccentrics and their other ends pivotally interconnected with the lower ends of guide bars 22 by means of pins 44.

A bolster assembly 46 is interposed between the upper and lower slides and, in accordance with the present invention, is adapted to be clampingly interengaged with the press frame during press operation, and released from such interengagement and supported for lateral displacement to a position outside the frame for inspection and maintenance purposes. In the embodiment disclosed, bolster assembly 46 includes a horizontally extending bolster plate member 48 having laterally opposite sides adjacent side portions 14 of the frame assembly, and depending side members 50 at each side of the bolster plate. Side members 50 overlie corresponding bolster assembly support members 52 which are mounted on the lower portion of the press frame assembly, and wedge members 54 are interposed between each side member 50 and the corresponding support member 52 to enable elevating and lowering the bolster assembly into and out of clamping interengagement with the frame assembly. Such clamping interengagement with the press frame is achieved by vertically opposed clamping surfaces on the bolster assembly and press frame which, in the embodiment disclosed, are defined by upper surfaces 55 on bolster plate 48 and opposed surfaces 57 provided on side portions 14 of the frame assembly. The structure of side members 50 of the bolster assembly, support members 52 and wedge members 54, and the operation thereof in connection with the foregoing functions, is described in greater detail hereinafter.

In connection with the forming of cup-shaped blanks from sheet metal, the underside of bolster plate 48 is provided with a plurality of annular blanking ring tools 56 suitably mounted thereon, lower slide 16 is provided with a plurality of corresponding blanking, holding and drawing ring tools 58, and upper slide 20 is provided with a corresponding plurality of punch members 60 which extend through openings 62 in bolster plate 48. Additionally, lower portion 12 of the press frame supports a corresponding plurality of ejection posts 64. With further regard to the blanking, holding and drawing ring tools 58, the latter are suitably mounted on a common mounting or adaptor plate 66 which is releasably attached to lower slide plate 68 by a plurality of bolts 70. Similarly, punches 60 are releaseably attached to a common adaptor or mounting plate 72 which is detachably connected to upper slide plate 74 by a plurality of bolts 76.

From the foregoing description of the cupping press, and from the well known structure and operation of tooling of the character described above, it will be appreciated that a flat sheet of metal, not shown, is adapted to be introduced into the press between lower slide 16 and bolster assembly 46 when the slide is in its lowermost position. Thereafter, in response to rotation of crankshaft 30, lower slide 16 is elevated for the metal sheet to be engaged between corresponding tools 56 and 58 which operate to sever a circular blank from the metal sheet and hold the blank while slide 20 descends for the corresponding punch 60 thereon to displace the blank into the cavity of tool 58 to draw the blank into a cup-shaped contour. Thereafter, the slides are displaced away from one another and from the bolster assembly, and ejection post 64 removes the drawn cup from the die cavity for removal from the press.

Figure 4:
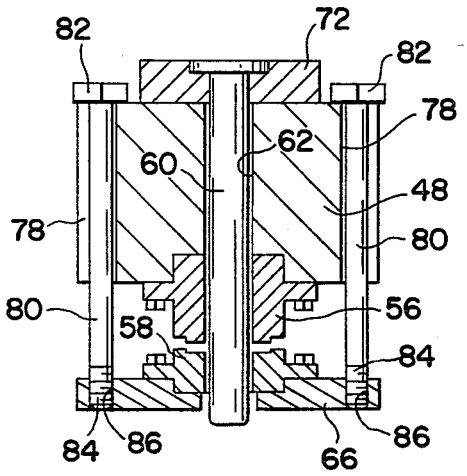
FIG. 4 is a sectional elevation view showing the bolster assembly supporting the upper and lower slide tooling.
Figure 5:
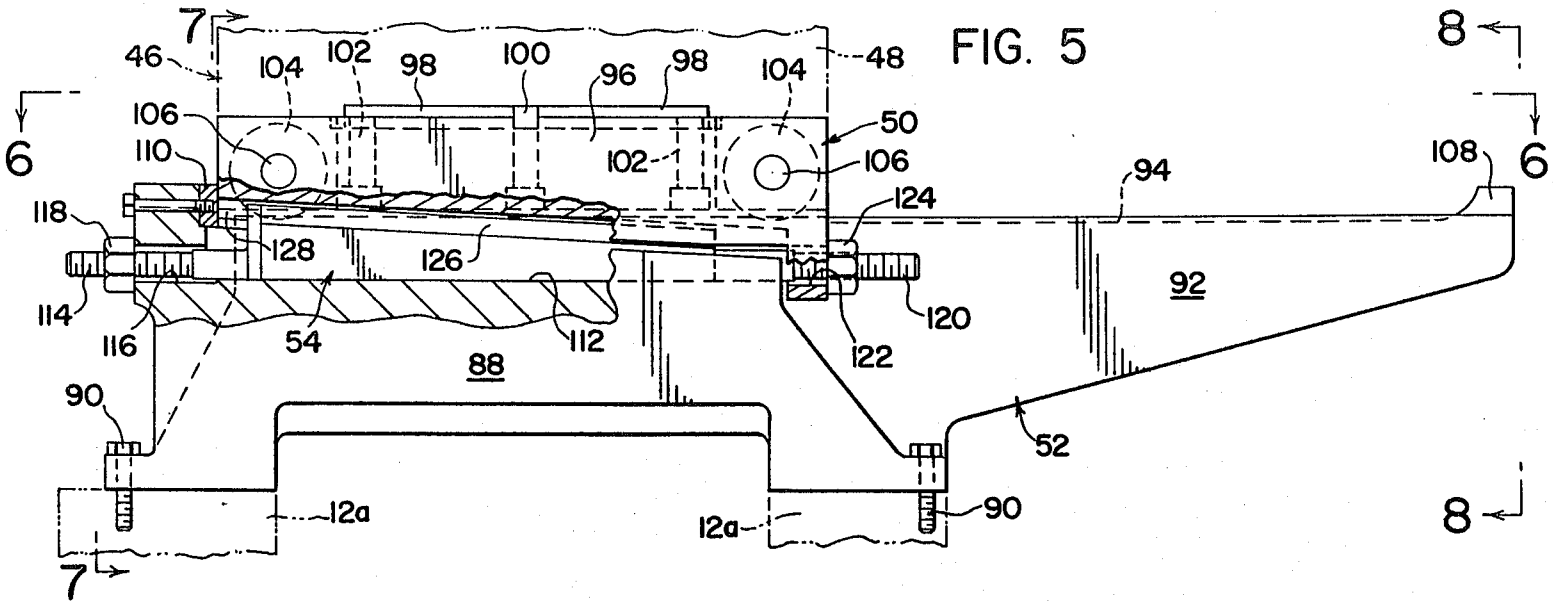
FIG. 5 is a detailed side elevation view of one of the bolster support assemblies.
Figure 6:
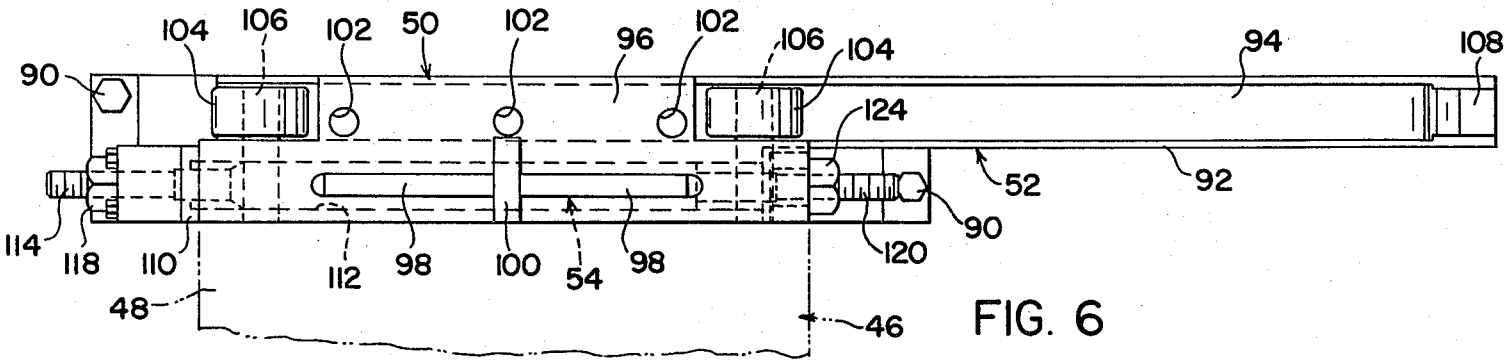
FIG. 6 is a plan view of the support assembly shown in FIG. 5.
Figure 7:
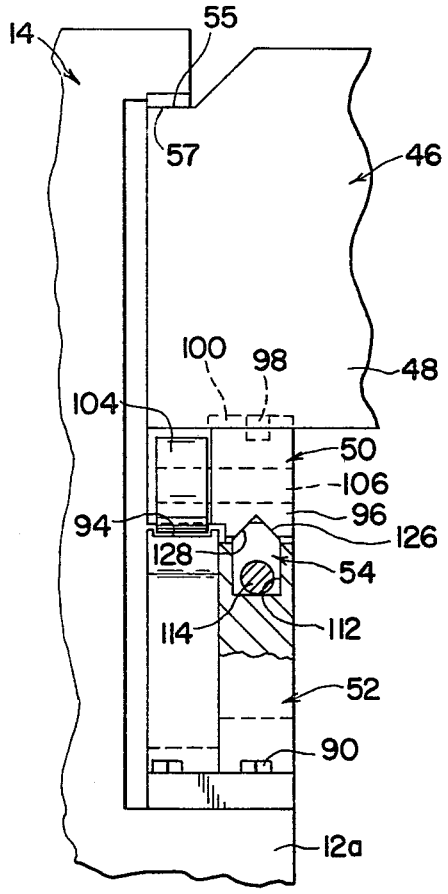
FIG. 7 is a sectional elevation view of the bolster support assembly taken along line 7—7 in FIG. 5; and, FIG. 8 is an end elevation view of the bolster support assembly taken along line 8—8 in FIG. 5.
Figure 8:
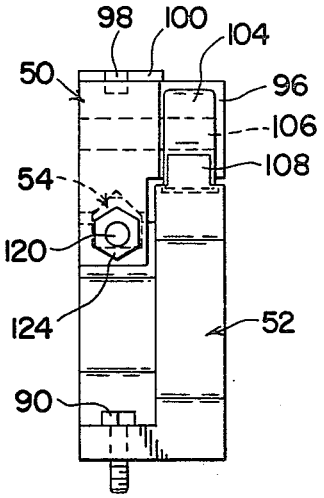

As mentioned above, and as will become more apparent hereinafter, bolster assembly 46 is adapted to be released from clamping interengagement with the press frame and supported for displacement laterally outwardly of the frame to the position shown by broken lines in FIG. 1. In the embodiment shown, the lower and upper slide tooling assemblies, as defined by tools 58 on mounting plate 66 of the lower slide and punches 60 on mounting plate 72 of the upper slide, are adapted to be supported by the bolster assembly for removal therewith from the press frame. In this respect, as will be appreciated from FIGS. 2 and 4 of the drawing, upper slide mounting plate 72 is adapted to be readily detached from upper slide plate 74 by the removal of bolts 76, whereby the upper mounting plate can be lowered onto the upper side of bolster plate 48 for the upper tooling assembly to be supported thereby. Likewise, mounting plate 66 is detached from lower slide plate 68 by removing bolts 70, whereby the mounting plate and tools 58 thereon can be temporarily attached to bolster plate 48 and supported in suspension therebeneath. Such temporary support of the lower tooling assembly can be achieved in any suitable manner, such as through the use of clamps, bolts, tie rod arrangements, or the like. One possible support arrangement is shown for purposes of example in FIG. 4. In this respect, the front and rear sides of bolster plate 48 are shown provided with outwardly open recesses 78 adapted to receive tie rods 80 having headed upper ends 82 engaging the upper surface of bolster plate 48. The lower ends 84 of the tie rods are threaded to interengage corresponding threaded openings 86 in mounting plate 66. It will be appreciated in connection with the use of such tie rods that the lower slide is inched upwardly toward the underside of bolster plate 48, preferably after mounting bolts 70 are removed, and that the tie rods are introduced laterally into recesses 78 and rotated to interengage ends 84 thereof with openings 86 in mounting plate 66, after which the slide is displaced downwardly from mounting plate 66 so that the latter and the tools thereon are suspended beneath the bolster plate.

The structures of one of the side members 50 of the bolster assembly and the corresponding support member 52 and wedge member 54 are shown in detail in FIGS. 5–8 of the drawing. The assemblies of these members, as seen in FIGS. 1–3, are disposed adjacent each of the side portions 14 of the press frame. The members of each assembly are structurally alike, whereby it will be appreciated that the ensuing description of the members shown in FIGS. 5–8 is applicable to both assemblies.

Referring now to the latter Figures, support member 52 includes an inner end 88 within the press frame and attached to underlying lower frame mounting blocks **12*a* by means of a plurality of bolts 90. The support member further includes an outer end 92 in the form of an arm extending laterally outwardly of the press frame from inner end 88. The inner and outer ends of the support member are provided with a continuous, horizontal track 94 adapted to support the corresponding side of the bolster assembly for displacement laterally outwardly and inwardly of the press frame as set forth more fully hereinafter. It will be appreciated, of course, that the two support members 52** provide laterally spaced apart parallel tracks for the latter purpose.

In the embodiment disclosed, side member 50 of bolster assembly 46 is adapted to be keyed and bolted to the underside of bolster plate 48. More particularly in this respect, side member 50 includes a body portion 96 having slots on its upper side to receive keys 98 and 100, and having bolt openings 102 therethrough to receive bolts by which bolster plate 48 is interconnected therewith. It will be appreciated of course that the underside of bolster plate 48 is provided with corresponding key slots and with threaded openings to receive the fastening bolts. Body portion 96 is laterally recessed adjacent its opposite ends, and a roller 104 is mounted in each recess by means of a corresponding axle pin 106. When the bolster assembly is released from interengagement with the press frame, rollers 104 are adapted to support the bolster assembly for rolling movement along track 94 between the inner and outer ends of the track. Outer portion 92 of support member 52 is preferably provided with an upwardly extending projection 108 adapted to be engaged by the roller 104 at the corresponding end of the bolster assembly to limit outward movement of the bolster assembly relative to the press. Further, inner end 88 of support member 52 is provided with a stop plate 110 attached thereto in a position to engage the corresponding end of body portion 96 of side member 50 to limit movement of the bolster assembly inwardly of the press frame and to properly position the bolster assembly within the frame for clamping interengagement therewith.

When the bolster assembly is positioned within the press frame it is elevated to disengage rollers 104 from track 94. Such elevation of the bolster assembly brings opposed surfaces 55 and 57 of the bolster assembly and press frame into interengagement, thus to clampingly interengage the bolster assembly with the press frame during press operation. In the preferred embodiment, such elevating and clamping interengagement is achieved by a wedging arrangement including wedge member 54 which is mounted on inner end 88 of support member 52 laterally inwardly of track 94. More particularly, inner end 88 of support member 52 is provided with a wedge receiving recess 112 extending parallel to track 94. Wedge member 54 is slidably received in recess 112 and is provided at its inner end with an operating stem 114 extending freely through an opening 116 in inner end 88 of the support member. Stem 114 is externally threaded to receive an operating nut 118 adapted to facially engage the outer surface of inner end 88 of the support member. Rotation to advance nut 118 in the direction of such facial engagement is adapted to axially displace wedge member 54 from right to left as viewed in FIG. 5. The outer end of wedge member 54 is provided with an operating stem 120 which extends freely through an opening 112 in side member 50 of the bolster assembly. Operating stem 120 is externally threaded to receive an operating nut 124 which facially engages the outer surface of slide member 50. Accordingly, rotation to advance nut 124 in the direction of such facial engagement displaces wedge member 54 from left to right in FIG. 5.

Wedge member 54 underlies body portion 96 of side member 56 when the bolster assembly is positioned at the inner end of track 94. Upper surface 126 of wedge member 54 is of inverted V-shape in cross section and includes downwardly in the direction from the inner end thereof towards the outer end, and the overlying portion of side member 50 of the bolster assembly is provided with an inverted V-shaped recess 128 which inclines downwardly in the direction from the inner end of the side portion toward the outer end thereof. It will be appreciated that surface 126 and recess 128 are of corresponding cross-sectional configuration and incline for cooperative interengagement to achieve elevation and lowering of the bolster assembly.

In the positions of the component parts shown in FIGS. 5–8 of the drawing, the inner end of the bolster assembly abuts stop blocks 110 of support members 52, and wedge members 54 are axially positioned relative to side portions 50 of the bolster assembly and inner ends 88 of support members 52 such that wedging surfaces 126 and 128 interengage and support the bolster assembly in its elevated position relative to the press frame. In such position of the bolster assembly, as described hereinabove, rollers 104 are elevated from tracks 94 and upper surfaces 55 of the bolster assembly are clampingly interengaged with press frame surfaces 57, whereby the bolster assembly is positioned and supported for press operation. When it is desired to release the bolster assembly for displacement laterally outwardly of the press frame, operating nuts 124 are removed from stems 120 and operating nuts 118 are rotated relative to stems 114 in the direction to displace wedge members 54 to the left in FIG. 5. It will be appreciated that such displacement of wedge members 54 lowers the bolster assembly for rollers 104 to engage tracks 94, whereafter the bolster is free to be displaced laterally outwardly of the press frame in rolling engagement with tracks 94. When it is desired to re-engage the bolster assembly and press frame, the bolster assembly is moved back into engagement with stop blocks 110 and operating nuts 124 are threaded onto stems 120 and advanced into facial engagement with the outer ends of side members 50. Thereafter, operating nuts 124 are advanced in the direction of such facial engagement to displace wedge members 54 to the right in FIG. 5, whereby wedging surfaces 126 and 128 interengage to elevate the bolster assembly into clamping interengagement with the press frame. It will be appreciated of course that operating nuts 118 will either be removed from stems 114 or displaced toward the outer ends thereof to facilitate displacement of wedge members 54 to the right in FIG. 5 during elevating of the bolster assembly and, after elevation of the bolster assembly, will be advanced into facial engagement with inner ends 88 of the support members to axially lock the wedge members in place during press operation.

In the embodiment disclosed, wherein the tooling associated with the upper slide of the press is a plurality of punches extending through corresponding openings in the bolster assembly, it will be appreciated that the upper tooling assembly would be released from the upper slide as described herein and supported on the upper side of the bolster assembly for removal therewith from the press frame. At the same time, it will be understood that this requirement with regard to the upper slide tooling is peculiar to the specific tooling arrangement necessary to operate the disclosed press as a cupping press, and that tooling arrangements could be employed with the press slides which would enable removal of the bolster assembly independent of the slide tooling. In this respect, for example, the upper and lower sides of the bolster plate of the bolster assembly could be provided with independent tooling each cooperable with tooling on the corresponding slide and the component parts of which tooling sets would be free of interference or interengagement with one another when the slides were positioned away from the bolster plate. Such an arrangement would enable removal of the bolster assembly alone to a position laterally outwardly of the frame for inspection of the tooling thereon and would facilitate visual inspection of the tooling on the press slides without removal thereof. At the same time, it will be appreciated that such a tooling arrangement would also enable release of the tooling assemblies on the slides and the support thereof on and under the bolster assembly for removal and return of the entire tooling package for the press.

While particular emphasis has been placed on the structure of the preferred embodiment and the structural interrelationship between the component parts thereof, many changes can be made in the preferred embodiment without departing from the principles of the present invention. In this respect, for example, it will be appreciated that the support members 52 could be formed integral with the press frame as opposed to being separate therefrom and mounted thereon and that, with such a construction or the construction shown herein, wedge members 54 are in effect interposed between the bolster assembly and press frame so as to achieve the desired clamping interengagement of the bolster assembly and frame. Thus, it will be further appreciated that wedge members 54 could be mounted directly on and supported by the press frame as opposed to being mounted on support members 52. With further regard to the wedge members, the latter could be slidably mounted on the bolster assembly rather than on the support members, and the inclined wedging surfaces could be provided on the wedge members and the support members rather than the wedge members and bolster assembly. Still further, while rollers 104 are preferred in order to minimize the work required to displace the bolster assembly along tracks 94, it will be appreciated that the bolster assembly could be slidably interengaged with the support members. Moreover, with regard to the roller support arrangement and clamping of the bolster assembly to the press frame, the rollers could be displaceable relative to the bolster assembly so as to lower the latter onto the support members, and the clamping surfaces of the press frame could be defined by clamping elements displaceable into engagement with the bolster assembly. Furthermore, while it is preferred to provide for the bolster plate of the bolster assembly to be detachably secured to side members 50 on which the rollers are mounted and which provide wedging surfaces 128 in the preferred embodiment, it will be appreciated that the rollers and wedging surfaces could be provided on the sides of a bolster plate alone, or that the sides of a bolster plate could be provided with depending side portions corresponding to side members 50 but formed integrally with the plate portion. These and other modifications will be obvious or suggested from the description herein of the preferred embodiment of the present invention.

Since many embodiments of the present invention can be made, and since many changes can be made in the embodiment herein illustrated and described, it is to be distinctly understood that the foregoing descriptive matter is to be interpreted merely as illustrative of the present invention and not as a limitation.

Having thus described the invention, it is claimed:

1. A press comprising, frame means, upper slide means supported by said frame means for vertical reciprocation, lower slide means supported by said frame means for vertical reciprocation, bolster means between said upper and lower slide means, means to reciprocate said upper and lower slide means toward and away from said bolster means, means supporting said bolster means for horizontal displacement relative to said frame means from a first position between said upper and lower slide means and a second position outwardly adjacent said frame means, and means releaseably interengaging said bolster means with said frame means when said bolster means is in said first position.

2. A press according to claim 1, wherein said bolster means supports first tool means cooperable with second and third tool means releaseably attached respectively to said upper and lower slides, and said bolster means includes means to support said second and third tool means for movement with said bolster means betweend said first and second positions thereof when said second and third tool means are released from the corresponding slide.

3. A press according to claim 1, wherein said means releaseably interengaging said bolster means with said frame means includes vertically opposed clamping surfaces on said frame means and bolster means, and means to elevate and lower said bolster means for said clamping surfaces to respectively engage and disengage one another.

4. A press according to claim 3, wherein said means to elevate and lower said bolster means includes wedge means interposed between said frame means and bolster means.

5. A press according to claim 4, wherein said wedge means includes wedge member means reciprocable relative to said frame means in the direction between said first and second positions of said bolster means, said wedge member means having inclined upper surface means, and inclined lower surface means on said bolster means engagable with said inclined upper surface means to elevate and lower said bolster means in response to reciprocation of said wedge member means.

6. A press according to claim 5, wherein said means supporting said bolster means for horizontal displacement includes track means on said frame means and roller means on said bolster means.

7. A press according to claim 1, wherein said means supporting said bolster means for horizontal displacement includes track means on said frame means and roller means on said bolster means.

8. A press according to claim 7, wherein said means to releaseably interengage said bolster means with said frame means includes means to relatively vertically displace said roller means and said track means when said bolster means is in said first position.

9. A press according to claim 8, wherein said means to relatively vertically displace said roller means and track means includes means to elevate said bolster means relative to said track means, and said means releaseably interengaging said bolster means and frame means further includes opposed surfaces on said frame means and bolster means interengaging in response to elevation of said bolster means.

10. A press according to claim 9, wherein said means to elevate said bolster means includes wedge member means displaceable relative to said track means and bolster means, and wedge surface means on said bolster means interengagable with said wedge member means.

11. A press comprising, frame means, upper and lower slide means supported by said frame means for vertical reciprocation, means to reciprocate said upper and lower slide means toward and away from one another, horizontally spaced apart track means on said frame means, bolster means including roller means engaging said track means to support said bolster means for horizontal displacement between a first position between said upper and lower slide means and a second position laterally outwardly of said frame means, said frame means and bolster means having clamping surfaces vertically opposed when said bolster means is in said first position, and means to elevate and lower said bolster means in said first position respectively to engage said opposed clamping surfaces and clampingly interengage said bolster means and frame means and to engage said roller means and track means for displacement of said bolster means to said second position.

12. A press according to claim 11, wherein said bolster means supports first tool means cooperable with second and third tool means releaseably attached respectively to said upper and lower slides, and said bolster means includes means to support said second and third tool means for movement with said bolster means between said first and second positions thereof when said second and third tool means are released from the corresponding slide.

13. A press according to claim 11, wherein said means to elevate and lower said bolster means includes means providing vertically opposed wedge surface means between said frame means and bolster means adjacent each said track means, and means to displace one of said wedge surface means horizontally relative to the other when said bolster means is in said first position.

14. A press according to claim 13, wherein said opposed wedge surface means includes inclined surface means on said bolster means and a wedge member slidable relative to each said track means and having surface means cooperatively inclined with respect to said inclined surface means on said bolster means.

15. A press comprising, frame means, upper slide means supported by said frame means for vertical reciprocation, lower slide means supported by said frame means for vertical reciprocation, bolster means between said upper and lower slide means, means to reciprocate said upper and lower slide means toward and away from said bolster means, a pair of horizontally spaced apart bolster support members mounted on said frame means, said support members providing a pair of horizontally extending parallel tracks including corresponding inner portions between said upper and lower slides and corresponding outer portions extending outwardly of said frame means, said bolster means including a horizontal plate portion and side portions each depending from said plate portion, a pair of rollers on each of said side portions for engaging the corresponding track to support said bolster means for rolling movement between a first position on said inner portions of said tracks and a second position on said outer portions of said tracks, a horizontally displaceable wedge member supported by each support member laterally adjacent the inner portion of the corresponding track, each said wedge member underlying the corresponding side portion of said bolster means when said bolster means is in said first position, each said support member and the corresponding wedge member and side portion of said bolster means having surfaces interengageable when said bolster means is in said first position to elevate and lower said bolster means and said rollers relative to said tracks in response to displacement of said wedge members in opposite directions, means to displace said wedge members in opposite directions, and surface means on said frame means and bolster means interengaging upon elevation of said bolster means by said wedge members to releaseably clamp said bolster means in place in said frame means.

16. A press according to claim 15, wherein said plate portion of said bolster means supports first tool means cooperable with second and third tool means releaseably attached respectively to said upper and lower slides, and said plate portion includes means to support said second and third tool means for rolling movement with said bolster means between said first and second positions thereof when said second and third tool means are released from the corresponding slide.

17. A press according to claim 15, wherein each said wedge member and the corresponding side portion of said bolster means have cooperatively inclined surfaces interengageable to elevate and lower said bolster means in response to displacement of said wedge members.

18. A press according to claim 15, wherein each said wedge member is disposed laterally inwardly of the inner portion of the corresponding track.

19. A press according to claim 15, wherein each said track has stop means at the opposite ends thereof to limit rolling movement of said bolster means in opposite directions along said tracks.

20. A press according to claim 17, wherein each said wedge member is disposed inwardly of the inner portion of the corresponding track.

21. A press according to claim 20, wherein each said track has stop means at the opposite ends thereof to limit rolling movement of said bolster means in opposite directions along said tracks.

* * * * *